United States Patent [19]

Tomoda et al.

[11] 4,307,871

[45] Dec. 29, 1981

[54] APPARATUS FOR AUTOMATICALLY PUNCHING THE TUYERES OF A CONVERTER

[75] Inventors: Yasuro Tomoda; Masaki Aizawa, both of Niihama; Osamu Isshiki, Saijo; Shigetoshi Maeda, Niihama, all of Japan

[73] Assignee: Sumitomo Metal Mining Co., Ltd., Tokyo, Japan

[21] Appl. No.: 140,814

[22] Filed: Apr. 16, 1980

[30] Foreign Application Priority Data

Apr. 27, 1979 [JP] Japan ..... 54-52383

[51] Int. Cl.[3] ..... F27B 7/20

[52] U.S. Cl. ..... 266/135; 266/271

[58] Field of Search ..... 266/45, 47, 135, 136, 266/269, 271, 272, 273, 287

[56] References Cited

U.S. PATENT DOCUMENTS

| | | | |
|---|---|---|---|
| 2,008,795 | 7/1935 | Olmstead | 266/136 |
| 2,425,792 | 8/1947 | Forbes | 266/136 |
| 3,667,748 | 6/1972 | Dienenthal et al. | 266/273 |
| 4,202,536 | 5/1980 | Demidowicz et al. | 266/135 |

FOREIGN PATENT DOCUMENTS

| | | | |
|---|---|---|---|
| 727540 | 2/1966 | Canada . | |
| 20-3503 | 10/1945 | Japan . | |
| 46-6684 | 2/1971 | Japan | 266/269 |
| 49-7775 | 2/1974 | Japan . | |

*Primary Examiner*—Peter K. Skiff

*Attorney, Agent, or Firm*—Watson, Cole, Grindle & Watson

[57] ABSTRACT

In an apparatus for punching the tuyeres of a converter for smelting of copper or nickel, the apparatus including a carrier frame supported by wheels and which is capable of moving on the working platform located adjacent to the converter, the carrier frame mounting a plurality of punch rods which can reciprocatingly extend into respective tuyeres to remove deposits therein. An electric motor is employed to drive the carrier frame and an electrical control system controls the operation of the electric motor and thus the movement of the carrier frame so that the correct positioning of the punch rods with respect to the tuyeres on a converter can be automatically achieved.

10 Claims, 3 Drawing Figures

APPARATUS FOR AUTOMATICALLY PUNCHING THE TUYERES OF A CONVERTER

BACKGROUND OF THE INVENTION

1. Field of the Invention

The present invention relates to an apparatus for punching the tuyeres of a converter which includes a plurality of punch rods that can be inserted into the tuyeres of a converter used to smelt mattes of copper or nickel so as to remove the solid deposits which form at the inner ends of the tuyeres.

2. Description of the Prior Art

In order to smelt mattes of copper or nickel, converters are used which generally have cylindrical configurations, such as the Peirce-Smith type converters, and mounted in a line along the sides of such converters are a plurality of spaced apart tuyeres which allow compressed air to be forced into the converters and to oxidize the iron and sulfur included in the molten materials therein (and thus smelt the materials). Since the forced air passing through the tuyeres is cold, solid deposits will be formed at the inner ends of the tuyeres where the cold air contacts the molten material inside the converters, and since blockage of these tuyeres is very detrimental to the functioning of the blowing operation, removal of the deposited materials is essential.

One known way of removing these deposits is to place individual punch rods in the tuyeres from the outside and to push manually a punch rod into and withdraw the same from the tuyeres in a "punching" operation so as to remove the deposits during the blowing of compressed air therethrough. However, this manual procedure is obviously very inefficient.

Various types of mechanical punchers have also been proposed to more efficiently remove the deposits from the insides of converter tuyeres. Various types of these punchers are shown in Canadian Pat. No. 727,540, issued on Feb. 8, 1966, Japanese Patent Publication No. 3503/30, published on May 25, 1955, and Japanese Patent Publication No. 7775/49, published on Feb. 24, 1974. One type of puncher involves the attachment of a punch rod to each individual tuyere. Another type of puncher includes a carrier frame which is mounted to move along the outside of the converter and has mounted thereon a single punch rod or a plurality of rods which can be inserted into the tuyeres. However, although this latter puncher is improved in function over the others, it too displays serious drawbacks insofar as a skilled worker must ride on the carrier frame and visually line up the punch rods with the respective tuyeres before the rods are punched into the tuyeres.

It is an object of the present invention to provide a punching apparatus which will include a plurality of parallel punch rods thereon that can be automatically and simultaneously reciprocated so as to be inserted into corresponding converter tuyeres and thus remove any solid deposits therein, and which will be automatically controlled so as to move along rails positioned adjacent the converter such that the punch rods will clean sequential sets of tuyeres as the punching apparatus travels from adjacent one end of the converter to the other, thereby cleaning all of the tuyeres during a cycle of punching apparatus operation.

SUMMARY OF THE PRESENT INVENTION

According to the present invention the punching apparatus will include a carrier frame which includes supporting wheels that will allow the carrier frame to move on a working platform along a line parallel with a line of uniformly spaced apart tuyeres on the side of a cylindrical converter used to smelt mattes of copper or nickel, and mounted on the carrier frame will be a plurality of aligned punch rods which will be uniformly spaced apart a distance equivalent to the spacing between the tuyeres, and will also be sufficiently long to fit in and through the corresponding tuyeres when the rods are reciprocatingly moved with respect to the carrier frame. The carrier frame will also have mounted thereon an electric motor which is connected to drive the carrier frame on the working platform, as well as a pulse generator that will generate pulses based on the revolution of an AC induction motor.

The inventive punching apparatus will include an electrical control system which will function to count the pulses generated by the pulse generator and based thereon first slow the motor which is moving the carrier frame on the working platform and then cause it to stop when the frame is at the desired position. Once the carrier frame is stopped, the punch rods will be reciprocatingly moved to remove the inner deposits on the corresponding tuyeres. Thereafter the motor will be activated to move the carrier frame on the working platform by a unit distance which will be sufficient for the punch rods to be able to punch a new set of tuyeres (a "set" of tuyeres being a plurality of tuyeres equal to the number of punch rods on the carrier frame). The punching apparatus will move along the entire length of the converter and return to its starting position to complete one punching cycle.

The carrier frame will also include a detecting means which will be capable of correcting the errors in the movement of the punching apparatus so as to cause it to be positioned exactly at its required standard starting point at the commencement of each punching cycle.

Further objects, advantages and features of the present invention will become more fully apparent from detailed consideration of the arrangement and construction of the constituent parts as set forth in the following specification taken together with the accompanying drawings.

DETAILED DESCRIPTION OF THE PRESENT INVENTION

Figure 1:
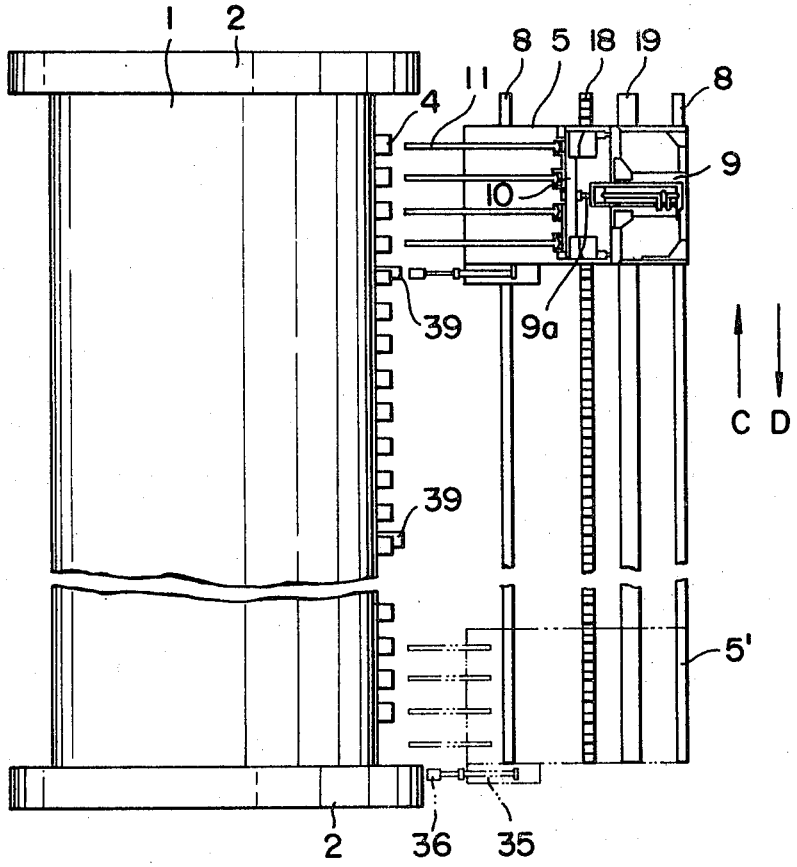
FIG. 1 shows a diagrammatic plan view of a punching apparatus constructed in accordance with the present invention and shown positioned to be capable of having its punch rods extend into a last set of tuyeres on the side of a cylindrical converter.
Figure 2:
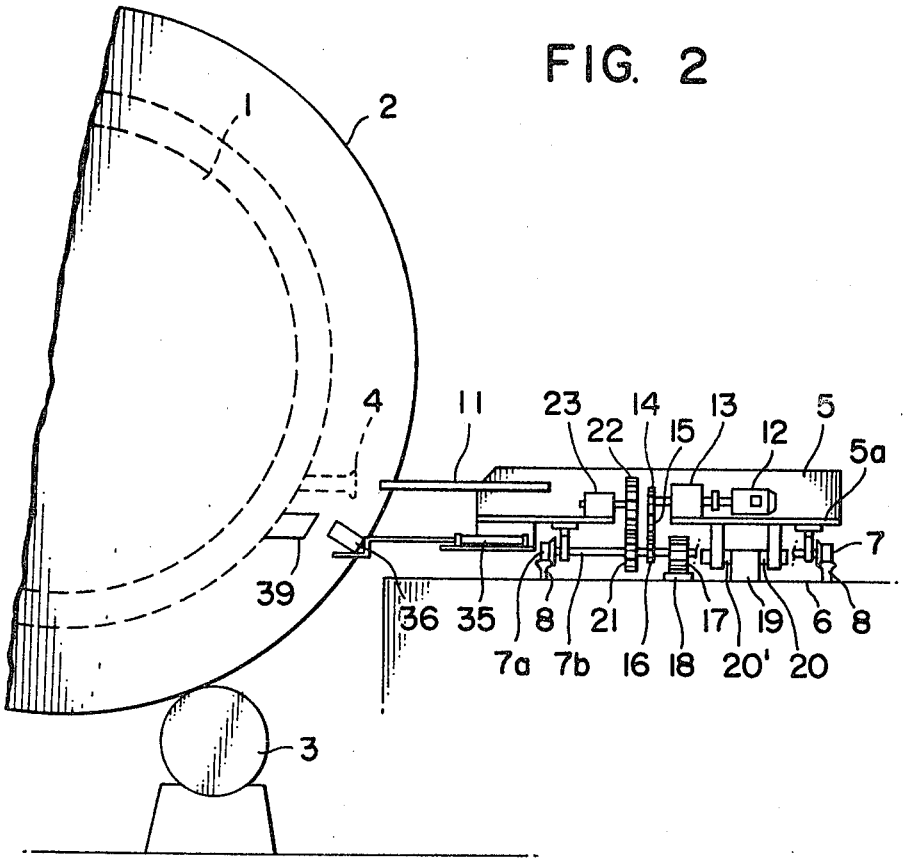
FIG. 2 shows a diagrammatic side view of the punching apparatus shown in FIG. 1, as well as a portion of the adjacent cylindrical converter.

FIGS. 1 and 2 show one embodiment of inventive punching apparatus operatively positioned adjacent to a cylindrical converter body 1. Converter body 1 includes converter tuyere 2 at opposite ends thereof which are themselves rotatably supported on supporting rollers 3 (only one supporting roller 3 is shown in FIG. 2 supporting one inclined side surface of a converter tuyere 2). On one side of the converter body 1 are a number of uniformly spaced apart tuyeres which communicate with the interior of the body 1 (the embodiment herein described has forty-eight tuyeres.) These tuyeres can be seen to be aligned along a line which runs parallel with the longitudinal axis of the converter body 1.

The inventive punching apparatus 5 is mounted on a flat working platform 6 which includes thereon a pair of spaced apart, elongated rails 8, an intermediate elongated rack rail 18 and an intermediate elongated thrust rail 19. Each of the these rails will be positioned to extend along a line parallel with the longitudinal axis of the cylindrical converter body 1 and sufficiently close to the body 1 that the inventive punching apparatus, when mounted thereon, will be operatively closely positioned with respect to the tuyeres 4.

The punching apparatus 5 includes a carrier frame 5*a* which is mounted on two spaced apart wheel sets composed of wheels 7 and 7*a*, and the wheels 7 and 7*a* are movably supported on rails 8. Mounted on the carrier frame 5*a* is an air cylinder 9 which includes a piston rod 9*a* that is capable of moving a transverse punching header 10 towards and away from air cylinder 9. Mounted on punching header 10 so as to extend perpendicularly away therefrom are four punch rods 11 that are uniformly spaced apart the same distance that tuyeres 4 are spaced apart and are sufficiently long that when aligned with tuyeres 4 and reciprocatingly moved by the movement of punching header 10, four punch rods will be capable of moving in, through, and out of the respective tuyeres 4.

Also mounted on carrier frame 5*a* is an AC induction motor 12 which includes a drive shaft that drives a reducer 13, which in turn drives a first chain wheel 14, which in turn drives, via roller chain 15, a second chain wheel 16 fixedly connected to an axle 7*b*. Thus, operation of motor 12 will cause rotation of axle 7*b* and thus, via meshing connection between a pinion gear 17 also fixedly connected to axle 7*b* and the rack rail 18, movement of the punching apparatus 5 along the rails 8.

Extending downwardly from carrier frame 5*a* on either side of thrust rail 19 are support rods which have mounted thereon thrust rollers 20 and 20' whose outer surfaces will engage the opposite sides of the thrust rail 19 to prevent the carrier frame 5*a* and thus the entire punching apparatus 5 from rocking, i.e., to the right or to the left in FIG. 2.

Axle 7*b* is seen to also fixedly mount a spur gear 21 which connects with another spur gear 22 that rotates a shaft connected to pulse generator 23. Rotation of axle 7*b* by motor 12 will also generate pulses in pulse generator 23.

Figure 3:
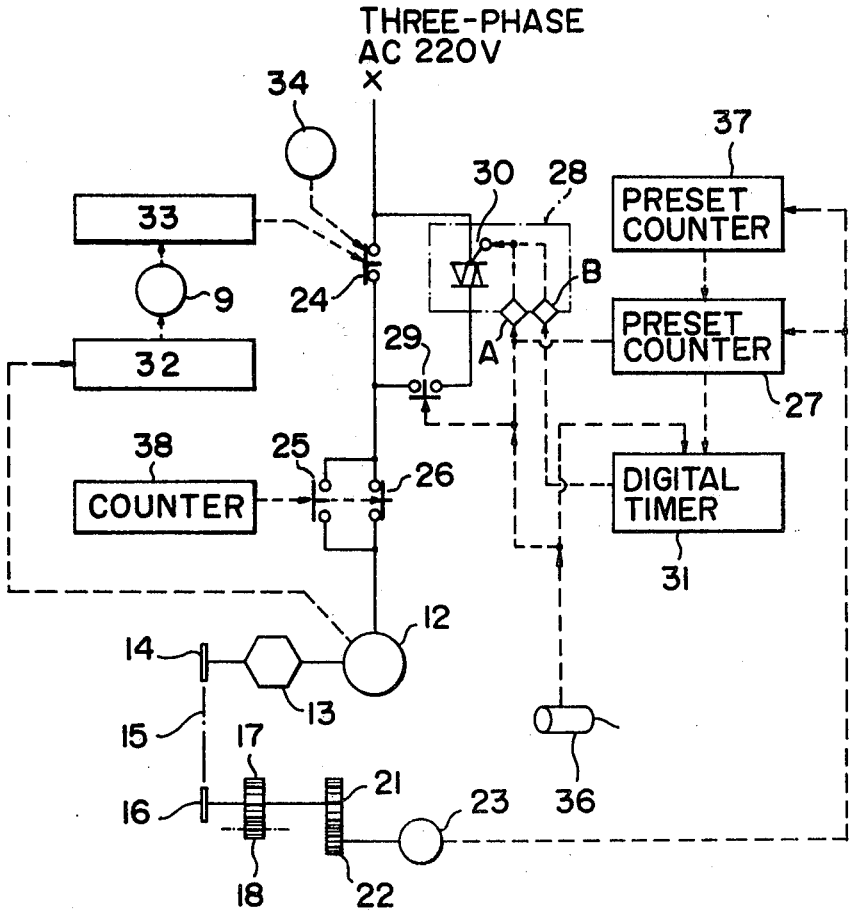
FIG. 3 shows a block diagram of the electrical control system used to control the punching apparatus shown in FIGS. 1 and 2.

FIG. 3 shows a block diagram of the electrical control system for the inventive punching apparatus and will function as follows. Standard available electric current at a commercial frequency will be supplied via line X, this current when unmodified being capable of running the motor 12 at a high speed. This will be the case when switch 24 is closed. Depending on whether switch 25 is closed or 26 is closed, the motor 12 will move the punching apparatus 5 either in the direction C as shown in FIG. 1 or D.

At the same time that motor 12 moves the punching apparatus 5, spur gears 21 and 22 will cause pulse generator 23 to send signals to preset counter 27 which has been preset with a number of pulses representative of the distance by which the punching apparatus 5 must move along rails 8 such that the punch rods will be extendable into the desired tuyeres. In the present embodiment the preset counter will be preset with the number of pulses that will correspond to the moving of the carrier frame 5*a* past four tuyeres on the cylindrical converter body 1. However, it is obvious that any lesser distance could be chosen, e.g., the number of pulses present in preset counter 27 could instead represent only one pitch or two of tuyeres.

When the number of pulses received in preset counter 27 reaches a certain amount (which is less than the noted preset number), a signal will be sent from preset counter 27 to terminal A of the current control means 28 connected to motor 12, which will then act to simultaneously open switch 24 (and thus stop the direct supply of standard frequency current to the motor 12) and close switch 29. Closing switch 29 will cause the standard frequency current to flow through thyristor 30 which will function to reduce the frequency of the current being fed to the motor 12 to about 1/5 of its original value, thus reducing the rotational frequency of motor 12 and likewise slowing down the movement of carrier frame 5*a* along rails 8. Simultaneously with the foregoing, the preset counter 27 will send a signal to the digital timer 31 to commence its operation. This digital timer 31 will operate until a predetermined time period (which will correspond to the time for the number of pulses fed to preset counter 27 to reach the preset number) has passed, and the digital timer 31 will then send a signal to terminal B of the current control means 28 to actuate thyristor 30 such that it will pass current in only one direction; thus acting to quickly stop motor 12 by damping direct current.

After the stopping of motor 12, timer 32 allows a small time period to pass, and then it activates air cylinder 9 and thus cause the reciprocating movement of punching rods 11 towards, into and away from tuyeres 4 (thus accomplishing the tuyere punching operation). A limit switch (not shown) will detect the completion of the tuyere punching operation and will activate timer 33. After a short time period, the timer 33 will then cause switch 24 to close, thus commencing the next unit of movement for the carrier frame 5*a*.

Since it is essential that the carrier frame 5*a* begins to move from its standard starting position indicated as 5' in FIG. 1, a cylinder 35 is mounted on the side of the carrier frame 5*a* (see FIG. 2) which supports a sensor 36 on the tip of its piston rod, which can detect a converter tuyere 2 at the end of the converter body 1. Sensor 36 can thereby accurately determine the standard starting point for the carrier frame 5*a*.

With the carrier frame 5*a* positioned at 5', the cycle starting button 34 is pushed so as to close switch 24 and thus open switch 29. The carrier frame 5*a* will then begin to advance as shown by arrow C in FIG. 1. The first unit of movement will, however, be different from the normal unit movement during an operational cycle due to need for the carrier frame to move by only a distance equal to the distance between the converter tire 2 and the first tuyere 4. This first distance of the movement of the carrier frame 5*a* will be determined by the preset counter 37, which is only used in starting of a cycle. The movements of the carrier frame 5*a* thereafter will be as programmed for a normal cycle.

The number of unit movements in the advancement of the carrier frame 5*a* will be counted by counter 38, which will control over the opening and closing of switch 25. When the carrier frame 5*a* comes to the last punching position in its advancement along direction C, the counter 38 will act to close switch 26 and to cause the motor 12 to move the carrier frame 5*a* in a return path as shown by arrow D in FIG. 1. After the last punching operation has ceased, and after the piston rod of cylinder 35 has been withdrawn into the cylinder 35, the punching apparatus 5 will continue its return towards position 5' and when the sensor 36 detects the converter tire 2, a signal will be sent to terminal A of the current control means 28 and the digital timer 31, and thus the digital timer 31 will be activated. In the same manner as noted previously, the carrier frame 5*a* will be reduced in its speed and will finally stop at the standard starting point 5'.

The movement of the carrier frame 5*a* from its standard starting point to the opposite end of the converter and then its return to its standard starting point will constitute one cycle of movement of the punching apparatus.

The noted control system having sensor 36, which allows the punching apparatus to be automatically located at a standard starting point for each cycle of movement, thus can compensate for any deviations which may occur in any accumulation of errors in the unit movement of the punching apparatus, and in the errors which may result from, for example, thermal expansions and/or contractions of distances between tuyeres, or from impediments encountered such as accumulations of dust on the rails. Therefore the accuracy of starting position of the carrier frame can be kept in the desired limit.

It should be noted that metal elements 39 can be positioned below the tuyeres on the converter body 1 at spaced apart locations along its longitudinal length, e.g., at its middle and at its far end in direction C, so that the sensor 36, which extends the piston rod 35 to the converter body 1, can be suitably activated as the carrier frame 5*a* moves therepast (either in direction C or D) and thus provide intermediate checks on the correct corresponding position thereof with respect to the tuyeres 4. When the deviations by intermediate checks of sensor 36 are out of the predetermined limit, an alarm can be sounded.

Although means 30 has been described as constituting a bidirectional thyristor, which cause the carrier frame to run at reduced speed and stop, any other element that would function in an equivalent fashion as previously described could also be employed.

While the present invention has been described with reference to the particular embodiment thereof, it will be understood that numerous modifications may be made by those skilled in the art without actually departing from the spirit and scope of the invention as defined in the appended claims.

We claim:

1. In an apparatus for punching the tuyeres of a converter for smelting of copper or nickel, the converter including a converter body and converter tuyeres, said tuyeres being uniformly spaced along a line extending longitudinally of the converter body, the apparatus including a carrier frame which is mounted on wheels so as to be movable on a working platform located adjacent to said converter, said carrier frame having supported thereon a plurality of aligned punch rods which are mounted so as to be reciprocatingly movable with respect to said carrier frame and movable into corresponding tuyeres for removing deposits therein, and the apparatus including an electric motor for driving said carrier frame on said working platform, the improvement wherein:

a pulse generator is mounted on said carrier frame and wherein means are provided for driving said pulse generator by said electric motor, a detector is mounted on said carrier frame so as to extend towards said converter and sense the converter tuyere therepast, and a control system is operatively connected to said carrier frame to control both the operation of the electric motor and thus the movement of the carrier frame on said working platform and the reciprocating movement of said aligned punch rods, said control system including a counter means for counting the pulses generated by said pulse generator and a current control means connected to operate said electric motor, said current control means being operated by signals emitted from said counter means and said detector.

2. The apparatus of claim 1 wherein said counter means is in the form of a preset counter, and wherein said current control means is capable of supplying current to said electric motor to run it at a high speed, or of supplying current to said electric motor at a reduced frequency to run it at a reduced speed, or of stopping it.

3. The apparatus of claim 2 wherein said current control means includes a current-control thyristor.

4. The apparatus of claim 2 wherein said preset counter is connected to said current control means and will send a first signal to said current control means to cause it to supply current at a reduced frequency to said electric motor when a number of pulses counted thereby from said pulse generator reaches a certain amount less than its preset number.

5. The apparatus of claim 4 wherein said control system includes a timer means connected between said preset counter and said current control means, and wherein a second signal from said preset counter will be sent simultaneously to said timer means with the sending of the first signal to the current control means so as to commence operation of said timer means, and wherein after a certain lapse of time has passed equal to the time for the preset counter to count pulses to reach the number to which said preset counter has been set, said timer means will send a signal to said current control means causing it to stop said electric motor.

6. The apparatus of claim 2 wherein said control system includes a switch which is activated by another counter means and is capable of reversing the flow of current through said electric motor and thus the direction of movement of said carrier frame along said line of tuyeres.

7. The apparatus of claim 2 wherein said control system includes a further preset counter which is connected between said pulse generator and said preset counter and is capable of controlling the operation of the electric motor during a first unit of movement of said carrier frame along the line of tuyeres such that the carrier frame will be suitably moved to enable the aligned punch rods thereon to be inserted in the first set of ventilation tuyeres.

8. The apparatus of claim 2 wherein a first timer is provided so as to operate the punch rods after a lapse of a short time period after stopping said electric motor.

9. The apparatus of claim 8 wherein a second timer is provided so as to move the next unit for the carrier frame after a lapse of a short time period following completing the operation of said punch rods.

10. The apparatus of claim 1 wherein metal elements are positioned at the middle of the tuyeres to detect the position when the piston rod is extended to, thereby the correct the position of said carrier frame.

* * * * *

UNITED STATES PATENT OFFICE

CERTIFICATE OF CORRECTION

PATENT NO. : 4,307,871

DATED : December 29, 1981

INVENTOR(S) : Yasuro Tomoda, Masaki Aizawa, Osamu Isshiki and Shigetoshi Maeda

It is certified that error appears in the above-identified patent and that said Letters Patent are hereby corrected as shown below:

Column 2, line 65, change "tuyere" to --tire--

Column 3, line 1, change "tuyere" to --tire--

Column 4, line 49, change "tuyere" to --tire--

Column 5, line 56, change "tuyeres" to --tire--

Column 6, line 6, change "tuyere" to --tire--

Column 6, line 66, cancel "the"

Column 6, line 67, change "correct" to --correcting--

Signed and Sealed this

*Eleventh* Day of *January 1983*

[SEAL]

*Attest:*

GERALD J. MOSSINGHOFF

*Attesting Officer*

*Commissioner of Patents and Trademarks*